US010868392B2

(12) United States Patent
Rossman et al.

(10) Patent No.: US 10,868,392 B2
(45) Date of Patent: Dec. 15, 2020

(54) GROUND COMMONING CONDUCTORS FOR ELECTRICAL CONNECTOR ASSEMBLIES

(71) Applicant: TE CONNECTIVITY CORPORATION, Berwyn, PA (US)

(72) Inventors: Jared Evan Rossman, Dover, PA (US); Kyle Robert Sammon, Lancaster, PA (US); Justin Dennis Pickel, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/247,729

(22) Filed: Jan. 15, 2019

(65) Prior Publication Data

US 2020/0227865 A1 Jul. 16, 2020

(51) Int. Cl.
*H01R 13/648* (2006.01)
*H01R 13/6587* (2011.01)
*H01R 13/6594* (2011.01)

(52) U.S. Cl.
CPC ..... *H01R 13/6587* (2013.01); *H01R 13/6594* (2013.01)

(58) Field of Classification Search
CPC ..... H01R 13/6599; H01R 13/6586; H01R 13/4587; H01R 13/6594
USPC ..... 439/607.1, 607.03, 607.01
See application file for complete search history.

(56) References Cited

U.S. PATENT DOCUMENTS

| | | | | |
|---|---|---|---|---|
| 8,167,652 | B1 * | 5/2012 | Ju | H01R 12/714 29/592.1 |
| 8,414,332 | B2 * | 4/2013 | Ju | H01R 13/41 439/342 |
| 8,419,472 | B1 | 4/2013 | Swanger et al. | |
| 9,407,045 | B2 | 8/2016 | Horning et al. | |
| 9,608,382 | B2 * | 3/2017 | McClellan | H01R 13/6587 |
| 9,666,991 | B2 | 5/2017 | Davis et al. | |
| 9,748,698 | B1 | 8/2017 | Morgan et al. | |
| 10,186,811 | B1 * | 1/2019 | Trout | H01R 13/6588 |
| 2012/0196481 | A1 * | 8/2012 | Ju | H01R 13/6599 439/626 |
| 2013/0149890 | A1 * | 6/2013 | Schroll | H01R 13/6586 439/449 |
| 2016/0028189 | A1 * | 1/2016 | Resendez | H01R 13/6585 439/607.01 |

(Continued)

*Primary Examiner* — Hae Moon Hyeon

(57) ABSTRACT

A connector assembly includes a housing having a base having signal contact channels and ground contact channels extending therethrough having ground contact channel walls defining the ground contact channels. The connector assembly includes signal contacts held in signal contact channels having mating ends for mating with mating signal contacts. The connector assembly includes ground contacts held in ground contact channels having mating ends for mating with mating ground contacts. The connector assembly includes ground commoning conductors within the housing including metal surface coverings deposited on the corresponding ground contact channel walls. Each ground commoning conductor extends into at least two ground contact channels and is oriented for direct electrical contact with at least two of the ground contacts or the mating ground contacts for electrically commoning the corresponding ground contacts or the mating ground contacts.

20 Claims, 6 Drawing Sheets

(56) References Cited

U.S. PATENT DOCUMENTS

| | | | | |
|---|---|---|---|---|
| 2018/0109043 | A1* | 4/2018 | Provencher | H01R 43/24 |
| 2019/0013625 | A1* | 1/2019 | Gailus | H01R 12/7076 |
| 2019/0305486 | A1* | 10/2019 | Trout | H01R 13/6583 |
| 2020/0005966 | A1* | 1/2020 | Blackburn | H01R 13/6593 |
| 2020/0091660 | A1* | 3/2020 | Trout | H01R 13/6594 |

* cited by examiner

GROUND COMMONING CONDUCTORS FOR ELECTRICAL CONNECTOR ASSEMBLIES

BACKGROUND OF THE INVENTION

The subject matter herein relates generally to grounding structures in electrical connector assemblies.

Electrical systems, such as those used in networking and telecommunication systems, utilize receptacle and header connectors to interconnect components of the system. However, as speed and performance demands increase, known electrical connectors are proving to be insufficient. Signal loss and/or signal degradation is a problem in known electrical systems, particularly at high data transfer speeds. Known electrical systems utilize differential pairs for signal transmission and provide electrical shielding for the signal transmission lines. Electrical shielding through cables or along circuit boards may be adequately controlled. However, electrical shielding through the electrical connectors may be difficult to control. Some known electrical connectors include secondary shields components, such as clips or secondary housings to provide shielding through the electrical connectors. However, such secondary shield components enlarge the electrical connectors, add components that increase manufacture and assembly cost.

A need remains for an electrical system having improved shielding to meet particular performance demands.

BRIEF DESCRIPTION OF THE INVENTION

In one embodiment, a connector assembly is provided including a housing having a base extending between a front and a rear, and the base having signal contact channels and ground contact channels extending therethrough having ground contact channel walls defining the ground contact channels. The connector assembly includes signal contacts held in corresponding signal contact channels and having mating ends configured for mating with mating signal contacts. The connector assembly includes ground contacts held in corresponding ground contact channels and having mating ends configured for mating with mating ends of mating ground contacts. The connector assembly includes ground commoning conductors within the housing. The ground commoning conductors include metal surface coverings deposited on the corresponding ground contact channel walls. Each ground commoning conductor extends into at least two ground contact channels and is oriented within the ground contact channels for direct electrical contact with at least two of the ground contacts or the mating ground contacts for electrically commoning the corresponding ground contacts or the mating ground contacts.

In another embodiment, a connector assembly is provided including a housing having a base extending between a front and a rear, and the base having signal contact channels and ground contact channels extending therethrough having ground contact channel walls defining the ground contact channels. The connector assembly includes contact modules arranged in a contact module stack coupled to the rear of the base of the housing. Each contact module has a plurality of cables extending from a rear of the contact module. Each contact module has a frame holding signal contacts and ground contacts. The signal contacts have mating ends configured for mating with mating signal contacts and cable ends terminated to signal conductors of the corresponding cables. The ground contacts are electrically connected to corresponding cables. The ground contacts have mating ends configured for mating with mating ends of mating ground contacts. The connector assembly includes ground commoning conductors within the housing including metal surface coverings deposited on the corresponding ground contact channel walls. Each ground commoning conductor extends into at least two ground contact channels. The ground commoning conductors are oriented within the ground contact channels for direct electrical contact with at least two of the ground contacts or the mating ground contacts for electrically commoning the corresponding ground contacts or the mating ground contacts.

In a further embodiment, an electrical connector assembly is provided including a header assembly and a receptacle assembly matable to the header assembly. The header assembly includes a header housing, header signal contacts arranged in pairs and held by the header housing, and header ground contacts held by the header housing. Each header ground contact has a mating end having an end wall, a first side wall extending from the end wall and a second side wall extending from the end wall. The end wall, the first side wall, and the second side wall define a C-shaped shield surrounding the corresponding pair of header signal contacts. The receptacle assembly includes a receptacle housing having a base extending between a front and a rear and having signal contact channels and ground contact channels extending therethrough. The signal contact channels receive corresponding header signal contacts when mated to the header assembly and the ground contact channels receive corresponding header ground contacts when mated to the header assembly. The ground contact channels have ground contact channel walls defining the ground contact channels. The receptacle assembly includes receptacle signal contacts held in corresponding signal contact channels having mating ends mated with corresponding header signal contacts in the signal contact channels. The receptacle assembly includes receptacle ground contacts held in corresponding ground contact channels having mating ends mated with mating ends of corresponding header ground contacts. The receptacle assembly includes ground commoning conductors within the receptacle housing including metal surface coverings deposited on the corresponding ground contact channel walls. Each ground commoning conductor extends into at least two ground contact channels and oriented within the ground contact channels for direct electrical contact with at least two of the header ground contacts for electrically commoning the corresponding header ground contacts.

DETAILED DESCRIPTION OF THE INVENTION

Figure 1:
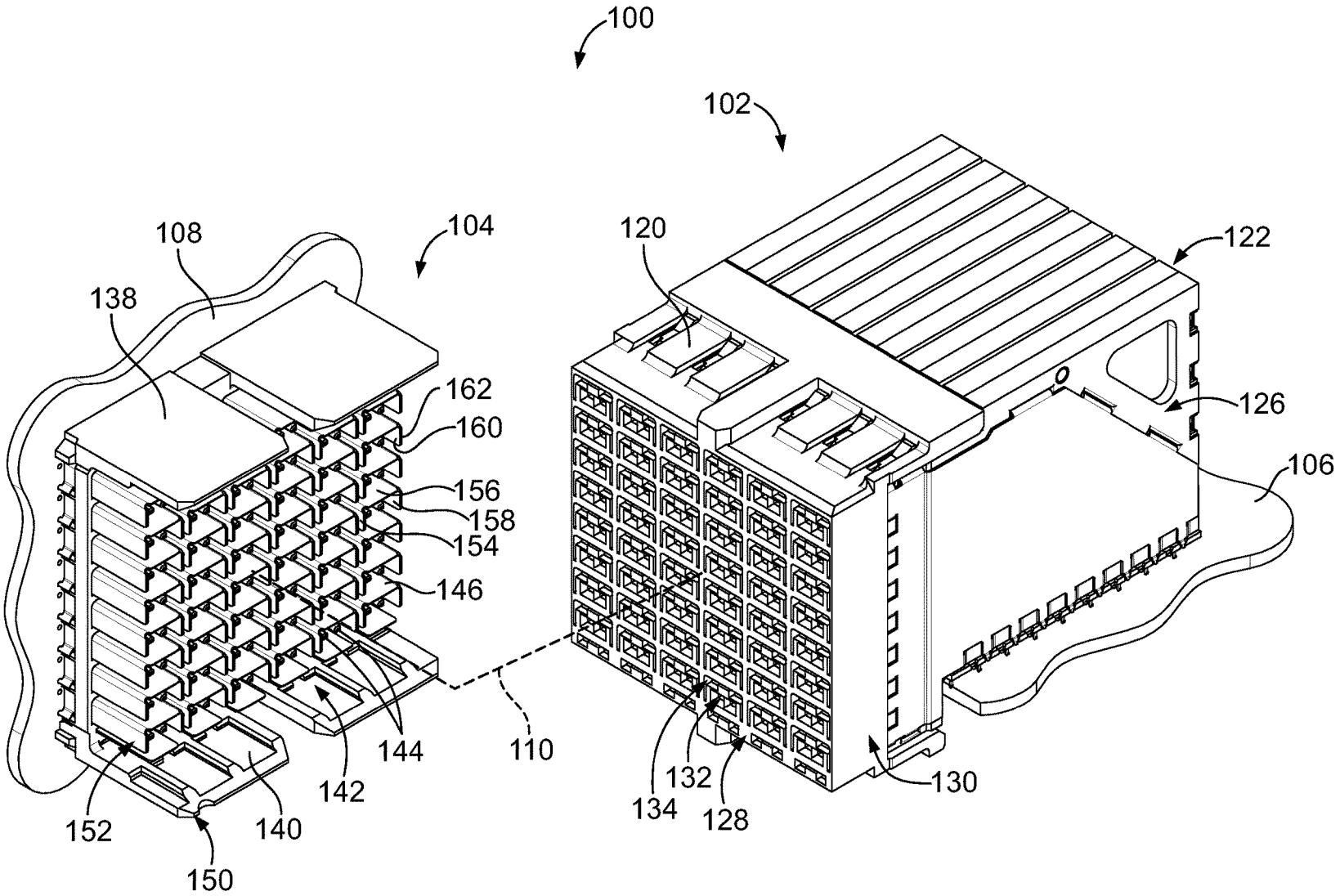
FIG. 1 is a perspective view of an exemplary embodiment of an electrical connector system illustrating a receptacle assembly and a header assembly in accordance with an exemplary embodiment.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". In the illustrated embodiment, the receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments. However, in alternative embodiments, the receptacle assembly 102 and/or the header assembly 104 may be a cable connector assembly electrically connected to cables rather than the circuit board 106 or 108.

A mating axis 110 extends through the receptacle and header assemblies 102, 104. The receptacle and header assemblies 102, 104 are mated together in a direction parallel to and along the mating axis 110.

The receptacle assembly 102 includes a receptacle housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) and receptacle ground contacts 125 (shown in FIG. 2) that are received in the receptacle housing 120 for mating with the header assembly 104. The receptacle signal contacts 124 may be arranged in differential pairs.

In an exemplary embodiment, the receptacle assembly 102 has a shield structure 126 for providing electrical shielding for the receptacle signal contacts 124. The shield structure 126 includes multiple components, electrically interconnected, which provide the electrical shielding. The receptacle ground contacts 125 form part of the shield structure 126. The shield structure 126 provides electrical shielding for the differential pairs of the receptacle signal contacts 124 to shield the differential pairs from one another. In an exemplary embodiment, the shield structure 126 is electrically connected to the header assembly 104 and/or the circuit board 106. For example, the shield structure 126 may be electrically connected to the header assembly 104 by the receptacle ground contacts 125. The shield structure 126 may be electrically connected to the circuit board 106 by features, such as ground pins. In an exemplary embodiment, the receptacle assembly 102 includes ground commoning conductors 260 (shown in FIG. 3) within the receptacle housing 120 for electrically connecting components of the shield structure 126, such as the receptacle ground contacts 125, and/or for electrically connecting components of the header assembly 104 (for example, header ground contacts). The ground commoning conductors 260 suppress narrowband resonance induced by high impedance ground structures. The ground commoning conductors 260 lower ground impedance by electrically commoning shield structures of the receptacle assembly 102 and/or the header assembly 104.

The receptacle assembly 102 includes a mating end 128 for mating with the header assembly 104. The receptacle signal contacts 124 are held in a base 130 of the receptacle housing 120 at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. In various embodiments, the columns of receptacle signal contacts 124 are all held in a common contact module 122. The receptacle signal contacts 124 also extend to a mounting end for mounting to the circuit board 106, which may be substantially perpendicular to the mating end 128 or which may be parallel to the mating end 128. In other various embodiments, the receptacle signal contacts 124 may extend to a cable end opposite the mating end 128 rather than the circuit board 106.

The base 130 of the receptacle housing 120 includes a plurality of signal contact channels 132 and a plurality of ground contact channels 134. The receptacle signal contacts 124 are received in corresponding signal contact channels 132. Optionally, a single receptacle signal contact 124 is received in each signal contact channel 132. The signal contact channels 132 may also receive corresponding header signal contacts 144 therein when the receptacle and header assemblies 102, 104 are mated. The ground contact channels 134 receive corresponding receptacle ground contacts 125 and are configured to receive header ground contacts 146 of the header assembly 104 when the receptacle and header assemblies 102, 104 are mated. The receptacle ground contacts 125 are mated with the header ground contacts 146 in the ground contact channels 134 to electrically common the receptacle and header assemblies 102, 104. In an exemplary embodiment, the receptacle housing 120 includes the ground commoning conductors 260 within the ground contact channels 134 to electrically common the header ground contacts 146 and/or the receptacle ground contacts 124.

The receptacle housing 120 is manufactured from a dielectric material, such as a plastic material, and provides isolation between the signal contact channels 132 and the ground contact channels 134. The receptacle housing 120 isolates the receptacle signal contacts 124 and the header signal contacts 144 from the header ground contacts 146. The receptacle housing 120 isolates each set of receptacle and header signal contacts 124, 144 from other sets of receptacle and header signal contacts 124, 144.

The header assembly 104 includes a header housing 138 having walls 140 defining a chamber 142. In various embodiments, the header housing 138 is mounted to the circuit board 108. However, in other various embodiments, the header housing 138 may hold contact modules, which may be terminated to the circuit board 108 or which may be terminated to ends of cables. The header assembly 104 has a mating end 150 for mating with the receptacle assembly 102. The receptacle assembly 102 is received in the chamber 142 through the mating end 150. The receptacle housing 120 engages the walls 140 to hold the receptacle assembly 102 in the chamber 142. The header signal contacts 144 and the header ground contacts 146 extend from a base 148 of the header housing 138 into the chamber 142. The header signal contacts 144 extend through signal contact channels 145 (shown in FIG. 5) in the base 148 and the header ground contacts 146 extend through ground contact channels 147 (shown in FIG. 5) in the base 148.

The header assembly 104 includes a shield structure to provide electrical shielding for the header signal contacts 144. The shield structure of the header assembly 104 is electrically commoned with the shield structure of the receptacle assembly 102 when mated thereto. The header ground contacts 146 define a part of the shield structure. In various embodiments, the header housing 138 may include ground commoning conductors 360 (shown in FIG. 5) forming part of the shield structure. The ground commoning conductors 360 are provided in the ground contact channels 147 and are electrically commoned to corresponding header ground contacts 146. The ground commoning conductors 360 suppress narrowband resonance induced by high impedance ground structures. The ground commoning conductors 360 lower ground impedance by electrically commoning shield structures of the header assembly 104.

In an exemplary embodiment, the header signal contacts 144 are arranged as differential pairs. The header signal contacts 144 are arranged in columns and rows. The header ground contacts 146 are positioned between the differential pairs to provide electrical shielding between adjacent differential pairs. In the illustrated embodiment, the header ground contacts 146 have mating ends 152 forming C-shaped header shields providing shielding on three sides of the pair of header signal contacts 144. The header ground contacts 146 have a plurality of walls, such as three planar walls 154, 156, 158. The walls 154, 156, 158 may be integrally formed or alternatively, may be separate pieces. The wall 156 defines an end wall or top wall of the header ground contact 146. The walls 154, 158 define first and second side walls that extend from the end wall 156. The bottom is open between the side walls 154, 158. The walls 154, 156, 158 have inner surfaces 160 that face the header signal contacts 144 and outer surfaces 162 opposite the inner surfaces 160. In an exemplary embodiment, the outer surfaces 162 of one or more of the walls 154, 156, 158 are configured to directly engage the ground commoning conductors 260 or 360 of the receptacle assembly 102 and/or the header assembly 104 to electrically common the header ground contacts 146. Other configurations or shapes for the header ground contacts 146 are possible in alternative embodiments. Greater or fewer walls may be provided in alternative embodiments. The walls may be bent or angled rather than being planar.

When the receptacle and header assemblies 102, 104 are mated, the header signal contacts 144 are received in the signal contact channels 132 of the receptacle housing 120 for mating with the receptacle signal contacts 124. The header signal contacts 144 are mating signal contacts for the receptacle signal contacts 124 and the receptacle signal contacts 124 are mating signal contacts for the header signal contacts 144. When the receptacle and header assemblies 102, 104 are mated, the header ground contacts 146 are received in the ground contact channels 134 of the receptacle housing 120 for mating with the receptacle ground contacts 125. The header ground contacts 146 are mating ground contacts for the receptacle ground contacts 125 and the receptacle ground contacts 125 are mating ground contacts for the header ground contacts 146.

Figure 2:
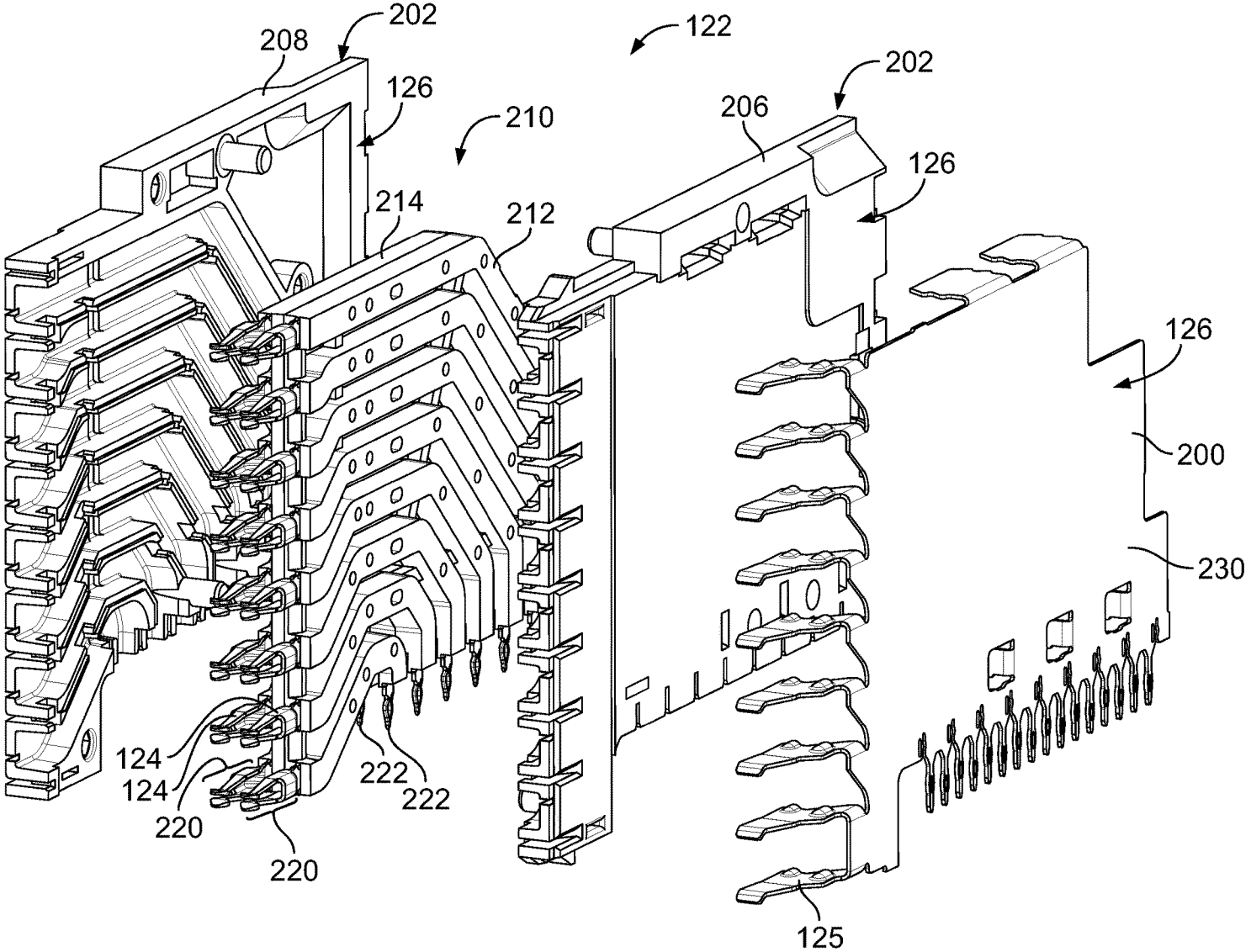
FIG. 2 is an exploded view of a contact module of the receptacle assembly in accordance with an exemplary embodiment.

FIG. 2 is an exploded view of one of the contact modules 122 and part of the shield structure 126. The shield structure 126 includes a ground shield 200 and a conductive holder 202. The ground shield 200 includes the receptacle ground contacts 125 configured to be electrically coupled to the header ground contacts 146 (shown in FIG. 1).

The contact module 122 includes the conductive holder 202, which in the illustrated embodiment includes a first holder member 206 and a second holder member 208 that are coupled together to form the holder 202. The holder members 206, 208 are fabricated from a conductive material. For example, the holder members 206, 208 may be die-cast from a metal material. Alternatively, the holder members 206, 208 may be stamped and formed or may be fabricated from a plastic material that has been metalized or coated with a metallic layer. By having the holder members 206, 208 fabricated from a conductive material, the holder members 206, 208 may provide electrical shielding for the receptacle assembly 102. When the holder members 206, 208 are coupled together, the holder members 206, 208 define at least a portion of the shield structure 126 of the receptacle assembly 102.

The holder members 206, 208 receive a frame assembly 210 and provide shielding around the frame assembly 210. The frame assembly 210 includes the receptacle signal contacts 124. The frame assembly 210 includes a pair of dielectric frames 212, 214 surrounding the receptacle signal contacts 124. In an exemplary embodiment, the receptacle signal contacts 124 are initially held together as lead frames (not shown), which are overmolded with dielectric material to form the dielectric frames 212, 214. Other manufacturing processes may be utilized to form the dielectric frames 212, 214 other than overmolding a lead frame, such as loading receptacle signal contacts 124 into a formed dielectric body.

The receptacle signal contacts 124 have mating ends 220 extending from the front and terminating ends 222 opposite the mating ends 220. In the illustrated embodiment, the terminating ends 222 extend from the bottom. Other configurations are possible in alternative embodiments. When the contact module 122 is assembled, the mating ends 220 extend forward from the front of the holder 202 for mating with the header signal contacts 144. The terminating ends 222 extend downward from the bottom of the holder for termination to the circuit board 106 (shown in FIG. 1). For example, the terminating ends 222 may be compliant pins, solder tails, and the like, for termination to the circuit board 106. In alternative embodiments, the terminating ends 222 may be cable ends configured to be terminated to signal conductors of a cable. For example, the conductors of the cables may be soldered to the cable ends of the receptacle signal contacts 124.

The ground shield 200 includes a main body 230 configured to be coupled to the conductive holder 202. In the illustrated embodiment, the main body 230 is generally planar. The ground shield 200 includes the receptacle ground contacts 125 extending forward from the main body 230. The ground shield 200 is manufactured from a metal material. The ground shield 200 may be a stamped and formed part.

In alternative embodiments, the contact module 122 may be provided without the conductive holder 202. For example, the ground shield 200 may be coupled to the side of the dielectric frame 212. In other various embodiments, the frame assembly 210 may be provided with a single dielectric frame, such as with all of the receptacle signal contacts 124 in a single dielectric frame. The receptacle signal contacts 124 may be arranged in a single column in such embodiments.

Figure 3:
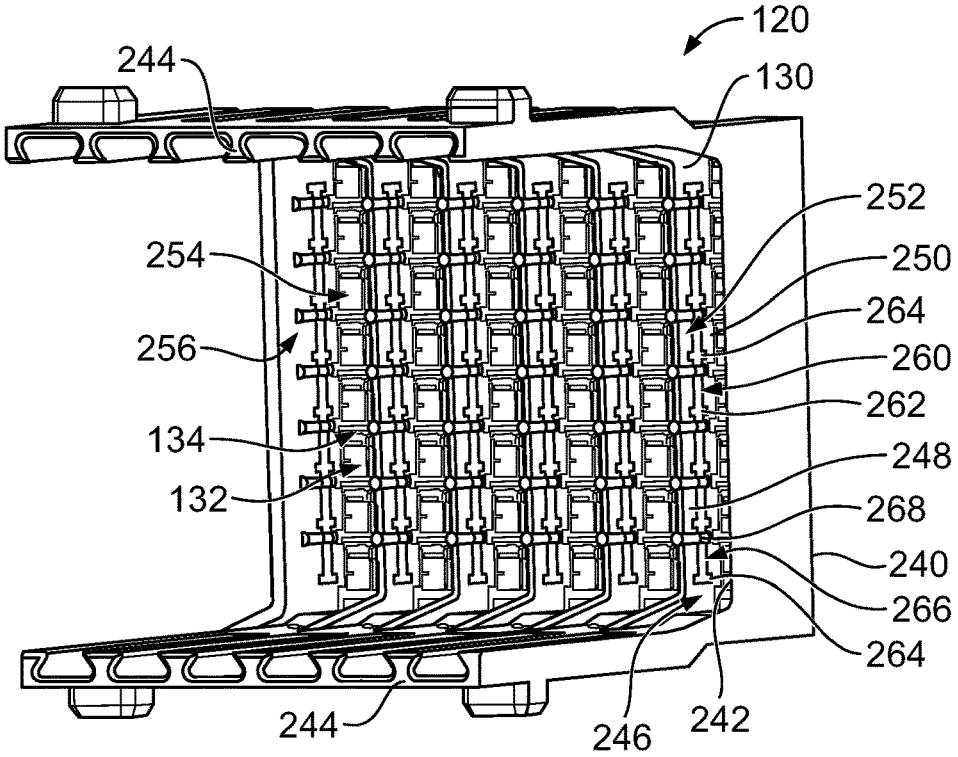
FIG. 3 is a rear perspective view of a receptacle housing of the receptacle assembly in accordance with an exemplary embodiment.

FIG. 3 is a rear perspective view of the receptacle housing 120 of the receptacle assembly 102 in accordance with an exemplary embodiment. The receptacle housing 120 includes the base 130 extending between a front 240 and a rear 242. The receptacle housing 120 includes shroud walls 244 extending from the rear 242 at the top and bottom of the receptacle housing 120. The shroud walls 244 are used to support the contact modules 122 (FIG. 2) when loaded into the receptacle housing 120. In an exemplary embodiment, the base 130 includes a plurality of chambers 246 at the rear 242. The chambers 246 are separated by separating walls 248 of the base 130. Each chamber 246 receives a different contact module 122. The chambers 246 are open between the separating walls 248 to receive a front end of the contact module 122. The signal contact channels 132 and the ground contact channels 134 are open to corresponding chambers 246.

The ground contact channels 134 are surrounded by ground contact channel walls 250 having wall surfaces 252 that define the ground contact channels 134. The ground contact channel walls 250 extend through an enclosed portion 254 of the base 130 at the front 240 and an open portion 256 of the base 130 defined by the separating walls 248 at the rear 242. In the illustrated embodiment, within the enclosed portion 254 of the base 130, the ground contact channel walls 250 extend along sides, the top, and the bottom of the ground contact channels 134 to enclose the ground contact channels 134 through the base 130. The ground contact channels 134 have a complementary shape to the shape of the header ground contacts 146 (shown in FIG. 1). For example, in the illustrated embodiment, the ground contact channels 134 are C-shaped having a first side channel portion, a top channel portion, and a second side channel portion that receive the header ground contact walls 154, 156, 158, respectively. Within the open portion 256 of the base 130, the ground contact channel walls 250 extend along sides of the ground contact channels 134 with the tops and bottoms of the ground contact channels being open within the chamber 246.

The receptacle housing 120 of the receptacle assembly 102 includes ground commoning conductors 260 within the receptacle housing 120. The ground commoning conductors 260 are used to electrically common multiple header ground contacts 146 (shown in FIG. 1) and/or receptacle ground contacts 125. The ground commoning conductors 260 include metal surface coverings 262 deposited on the ground contact channel walls 250. For example, the metal surface coverings 262 may be metal plating deposited directly on the wall surfaces 252. In the illustrated embodiment, the metal surface coverings 262 are deposited on the separating walls 248 in the open portion 256 of the base 130. However, the metal surface coverings 262 may additionally or alternatively be deposited on the wall surfaces 252 in the enclosed portion 254.

The ground commoning conductors 260 extend into multiple ground contact channels 134. For example, in various embodiments, the ground commoning conductors 260 extend into each of the ground contact channels 134 within the corresponding chamber 246. The ground commoning conductors 260 are oriented within the ground contact channels 134 for direct electrical contact with a plurality of the header ground contacts 146 and/or the receptacle ground contacts 125. The ground commoning conductors 260 electrically common the corresponding header ground contacts 146 and/or the receptacle ground contacts 125. The ground commoning conductors 260 suppress narrowband resonance induced by the header ground contacts 146 and the receptacle ground contacts 125 at the mating interface. The ground commoning conductors 260 lower ground impedance by electrically commoning the header ground contacts 146 and/or the receptacle ground contacts 125 proximate to the mating interface between the receptacle assembly 102 and the header assembly 104. Optionally, the ground commoning conductors 260 may be positioned for interfacing with the header ground contacts 146 proximate to distal ends of the header ground contacts 146.

In an exemplary embodiment, the metal surface coverings 262 of the ground commoning conductors 260 include pads 264 defining mating interfaces 266 oriented within the ground contact channels 134 for direct electrical contact with the corresponding header ground contacts 146 and/or the receptacle ground contacts 125. In an exemplary embodiment, the metal surface coverings 262 of the ground commoning conductors 260 include traces 268 between the pads 264. The traces 268 electrically connect the pads 264. The pads 264 may be wider than the traces 268 in various embodiments. In an exemplary embodiment, the metal surface coverings 262 of the ground commoning conductors 260 are plated surface coverings deposited directly on the dielectric material of the receptacle housing 120. The receptacle housing 120 is selectively plated in select areas designed to interface with the header ground contacts 146 and/or the receptacle ground contacts 125. Optionally, the pads 264 may be planar. In other various embodiments, the pads 264 may be nonplanar, such as being deposited on a curved area of the header housing 138, such as a bump or protrusion designed to interface with the header ground contacts 146 and/or the receptacle ground contacts 125. Each pad 264 defines a point of contact for the corresponding header ground contact 146 and/or the receptacle ground contact 125. In an exemplary embodiment, the mating interfaces 266 are separable mating interfaces from which the header ground contact 146 may be separated.

In an exemplary embodiment, the ground contact channels 134 are arranged in columns and rows. In the illustrated embodiment, the columns are oriented vertically and the rows are oriented horizontally. In various embodiments, the ground commoning conductors 260 extend into each ground contact channel 134 within the corresponding column for electrically connecting each of the header ground contacts 146 and/or the receptacle ground contacts 125 in the associated column. In other various embodiments, the ground commoning conductors 260 extend into each ground contact channel 134 within the corresponding row for electrically connecting each of the header ground contacts 146 and/or the receptacle ground contacts 125 in the associated row.

Figure 4:
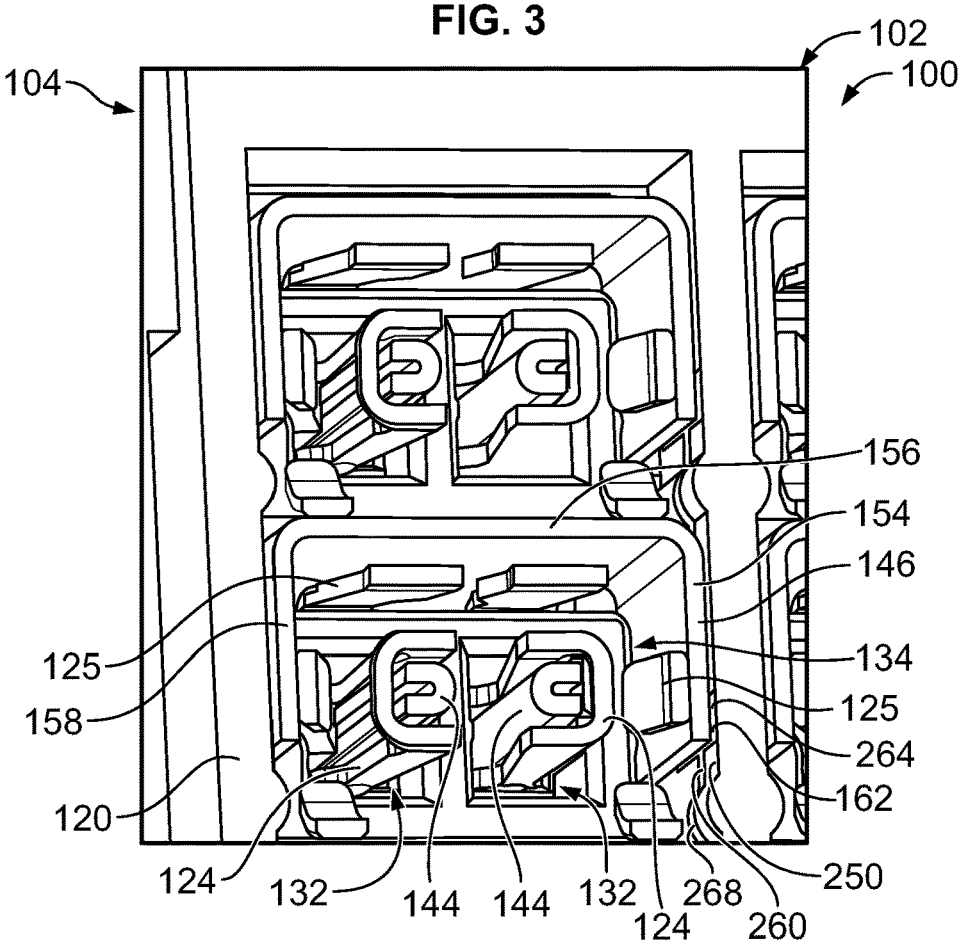
FIG. 4 is a sectional view of the electrical connector system showing the receptacle assembly mated with the header assembly.

FIG. 4 is a sectional view of the electrical connector system 100 showing the receptacle assembly 102 mated with the header assembly 104. When mated, the header signal contacts 144 are received in the signal contact channels 132 of the receptacle housing 120 for mating with the receptacle signal contacts 124 and the header ground contacts 146 are received in the ground contact channels 134 of the receptacle housing 120 for mating with the receptacle ground contacts 125. FIG. 4 illustrates the receptacle ground contacts 125 having multiple beams rather than the single beam receptacle ground contacts 125 illustrated in FIG. 2. In the illustrated embodiment, the header ground contacts 146 directly electrically contact the ground commoning conductors 260 deposited on the ground contact channel walls 250.

The outer surfaces 162 of the side walls 154, 158 directly electrically contact the pads 264 of the ground commoning conductors 260. The traces 268 electrically connect the pads 264 to electrically common the header ground contacts 146 within the column. The electrical connection created by the ground commoning conductors 260 lowers ground impedance of the shield structure. The electrical connection created by the ground commoning conductors 260 suppresses narrowband resonance to improve signal integrity for the electrical connector system 100.

Figure 5:
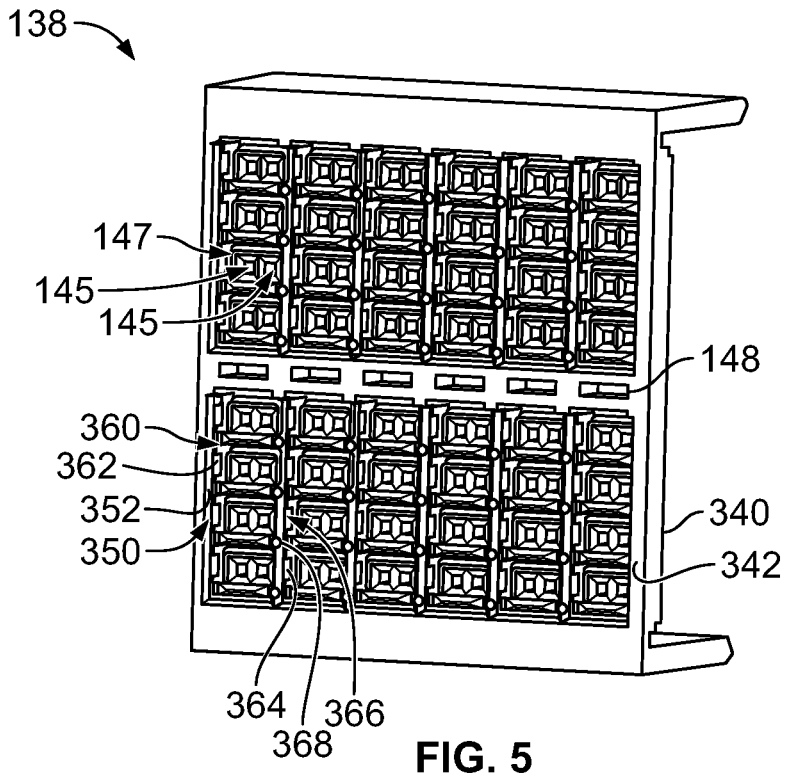
FIG. 5 is a rear perspective view of a header housing of the header assembly in accordance with an exemplary embodiment.

FIG. 5 is a rear perspective view of the header housing 138 of the header assembly 104 in accordance with an exemplary embodiment. The header housing 138 includes the base 148 extending between a front 340 and a rear 342. The signal contact channels 132 and the ground contact channels 147 extend through the base 148. The ground contact channels 147 are surrounded by ground contact channel walls 350 having wall surfaces 352 that define the ground contact channels 147. In the illustrated embodiment, the ground contact channel walls 350 extend along sides, the top, and the bottom of the ground contact channels 147 to enclose the ground contact channels 147 through the base 148. The ground contact channels 147 have a complementary shape to the shape of the header ground contacts 146 (shown in FIG. 1). For example, in the illustrated embodiment, the ground contact channels 147 are C-shaped having a first side channel portion, a top channel portion, and a second side channel portion that receive the header ground contact walls 154, 156, 158, respectively.

In an exemplary embodiment, the header housing 138 of the receptacle assembly 102 includes ground commoning conductors 360 within the header housing 138. The ground commoning conductors 360 are used to electrically common multiple header ground contacts 146. The ground commoning conductors 360 include metal surface coverings 362 deposited on the ground contact channel walls 350. For example, the metal surface coverings 362 may be metal plating deposited directly on the wall surfaces 352.

The ground commoning conductors 360 extend into multiple ground contact channels 147. For example, in various embodiments, the ground commoning conductors 360 extend into each of the ground contact channels 147 within the corresponding chamber 346. The ground commoning conductors 360 are oriented within the ground contact channels 147 for direct electrical contact with a plurality of the header ground contacts 146. The ground commoning conductors 360 electrically common the corresponding header ground contacts 146. The ground commoning conductors 360 suppress narrowband resonance induced by the header ground contacts 146 through the header assembly 104. The ground commoning conductors 360 lower ground impedance by electrically commoning the header ground contacts 146 proximate to the mating interface between the receptacle assembly 102 and the header assembly 104.

In an exemplary embodiment, the metal surface coverings 362 of the ground commoning conductors 360 include pads 364 defining mating interfaces 366 oriented within the ground contact channels 147 for direct electrical contact with the corresponding header ground contacts 146. In an exemplary embodiment, the metal surface coverings 362 of the ground commoning conductors 360 include traces 368 between the pads 364. The traces 368 electrically connect the pads 364. The pads 364 may be wider than the traces 368 in various embodiments. In an exemplary embodiment, the metal surface coverings 362 of the ground commoning conductors 360 are plated surface coverings deposited directly on the dielectric material of the header housing 138. The header housing 138 is selectively plated in select areas designed to interface with the header ground contacts 146. Optionally, the pads 364 may be planar. In other various embodiments, the pads 364 may be nonplanar, such as being deposited on a curved area of the header housing 138, such as a bump or protrusion designed to interface with the header ground contacts 146. Each pad 364 defines a point of contact for the corresponding header ground contact 146.

In an exemplary embodiment, the ground contact channels 147 are arranged in columns and rows. In the illustrated embodiment, the columns are oriented vertically and the rows are oriented horizontally. In various embodiments, the ground commoning conductors 360 extend into each ground contact channel 147 within the corresponding column for electrically connecting each of the header ground contacts 146 in the associated column. In other various embodiments, the ground commoning conductors 360 extend into each ground contact channel 147 within the corresponding row for electrically connecting each of the header ground contacts 146 in the associated row.

Figure 6:
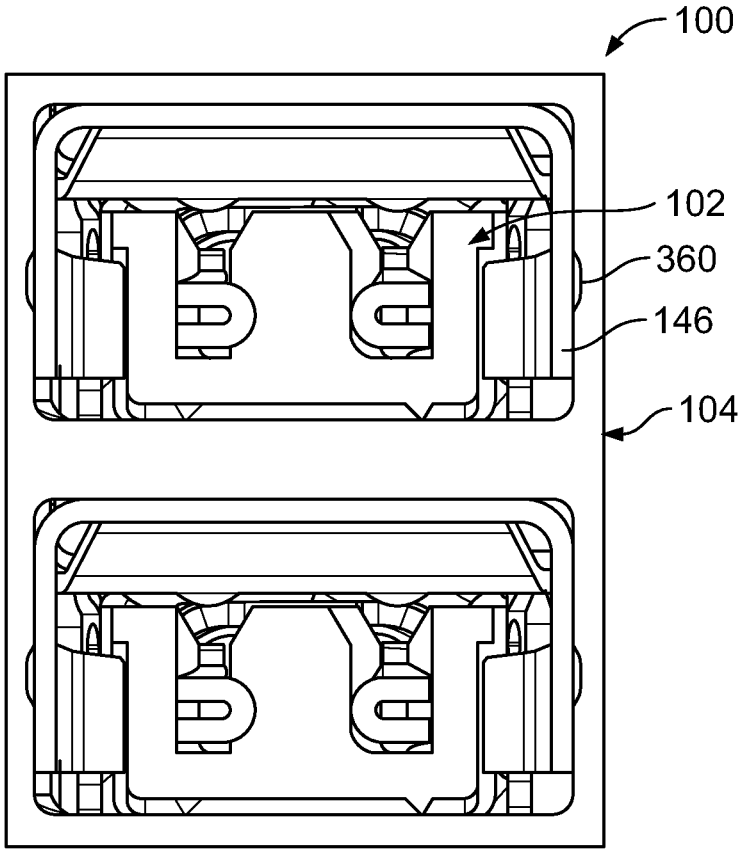
FIG. 6 is a sectional view of the electrical connector system showing the receptacle assembly mated with the header assembly.

FIG. 6 is a sectional view of the electrical connector system 100 showing the receptacle assembly 102 mated with the header assembly 104. In the illustrated embodiment, the header ground contacts 146 directly electrically contact the ground commoning conductors 360 deposited on the ground contact channel walls 350. The outer surfaces 162 of the side walls 154, 158 directly electrically contact the pads 364 of the ground commoning conductors 360. The electrical connection created by the ground commoning conductors 360 lowers ground impedance of the shield structure. The electrical connection created by the ground commoning conductors 360 suppresses narrowband resonance to improve signal integrity for the electrical connector system 100.

Figure 7:
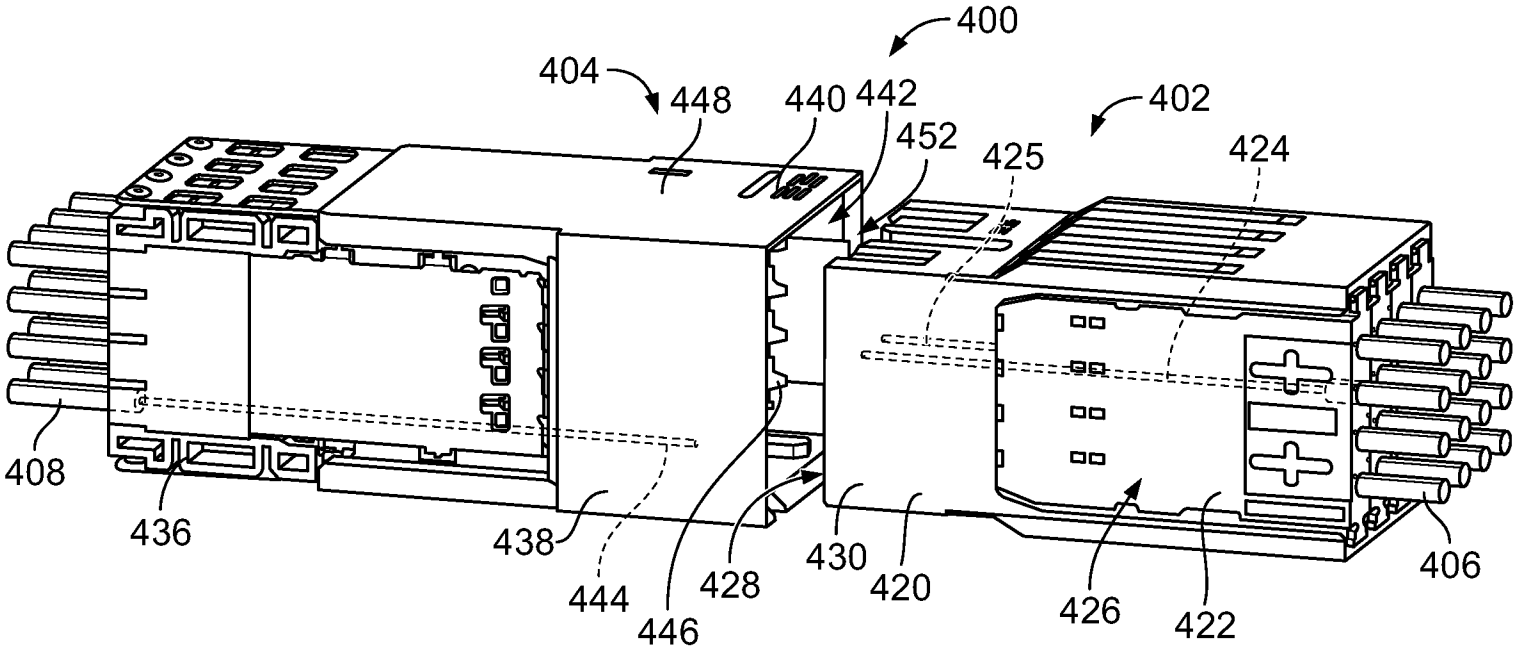
FIG. 7 is a perspective view of an exemplary embodiment of an electrical connector system illustrating a receptacle assembly and a header assembly in accordance with an exemplary embodiment.

FIG. 7 is a perspective view of an exemplary embodiment of an electrical connector system 400 illustrating a receptacle assembly 402 and a header assembly 404 that may be directly mated together. The electrical connector system 400 is similar to the electrical connector system 100 shown in FIG. 1, however, the electrical connector system 100 is a cable electrical system having the receptacle assembly 402 and the header assembly 404 being cable connector assemblies rather than board connector assemblies. The receptacle assembly 402 and/or the header assembly 404 may be referred to hereinafter individually as a "connector assembly" or collectively as "connector assemblies". The receptacle assembly 402 includes a plurality of cables 406 extending therefrom and the header assembly 404 includes a plurality of cables 408 extending therefrom.

The receptacle assembly 402 includes a receptacle housing 420 that holds a plurality of contact modules 422. Any number of contact modules 422 may be provided to increase the density of the receptacle assembly 402. The contact modules 422 each include a plurality of receptacle signal contacts 424 (one of which is shown in phantom in FIG. 7) and receptacle ground contacts 425 (one of which are shown in phantom in FIG. 7) that are received in the receptacle housing 420 for mating with the header assembly 404. The receptacle signal contacts 424 may be arranged in differential pairs.

In an exemplary embodiment, the receptacle assembly 402 has a shield structure 426 for providing electrical shielding for the receptacle signal contacts 424. The shield structure 426 includes multiple components, electrically interconnected, which provide the electrical shielding. The receptacle ground contacts 425 form part of the shield structure 426. The shield structure 426 is electrically connected to the cables 406, such as by soldering to cable shields of the cables 406. In an exemplary embodiment, the receptacle assembly 402 includes ground commoning conductors 560 (shown in FIG. 8) within the receptacle housing 420.

The receptacle assembly 402 includes a mating end 428 for mating with the header assembly 404. The receptacle signal contacts 424 are held in a base 430 of the receptacle housing 420 at the mating end 428 for mating to the header assembly 404. The receptacle signal contacts 424 extend to a cable end opposite the mating end 428 for termination to the cables 406.

The header assembly 404 includes a header housing 438 having walls 440 defining a chamber 442. The header housing 438 holds contact modules 436 having the cables 408 extending from the cable ends of the contact modules 436. The header assembly 404 has a mating end 452 for mating with the receptacle assembly 402. The receptacle assembly 402 is received in the chamber 442 through the mating end 452. The receptacle housing 420 engages the walls 440 to hold the receptacle assembly 402 in the chamber 442. Header signal contacts 444 (shown in phantom in FIG. 7) and header ground contacts 446 extend from a base 448 of the header housing 438 into the chamber 442. The header signal contacts 444 extend through signal contact channels 445 (FIG. 9) in the base 448 and the header ground contacts 446 extend through ground contact channels 447 (FIG. 9) in the base 448.

The header assembly 404 includes a shield structure to provide electrical shielding for the header signal contacts 444. The shield structure of the header assembly 404 is electrically commoned with the shield structure of the receptacle assembly 402 when mated thereto. The header ground contacts 446 define a part of the shield structure. In various embodiments, the header housing 438 may include ground commoning conductors 660 (shown in FIG. 9) forming part of the shield structure. The ground commoning conductors 660 are electrically commoned to corresponding header ground contacts 446.

In the illustrated embodiment, the header ground contacts 446 have mating ends 452 forming C-shaped header shields. The header ground contacts 446 are configured to directly engage the ground commoning conductors 560 or 660 of the receptacle assembly 402 and/or the header assembly 404 to electrically common the header ground contacts 446.

Figure 8:
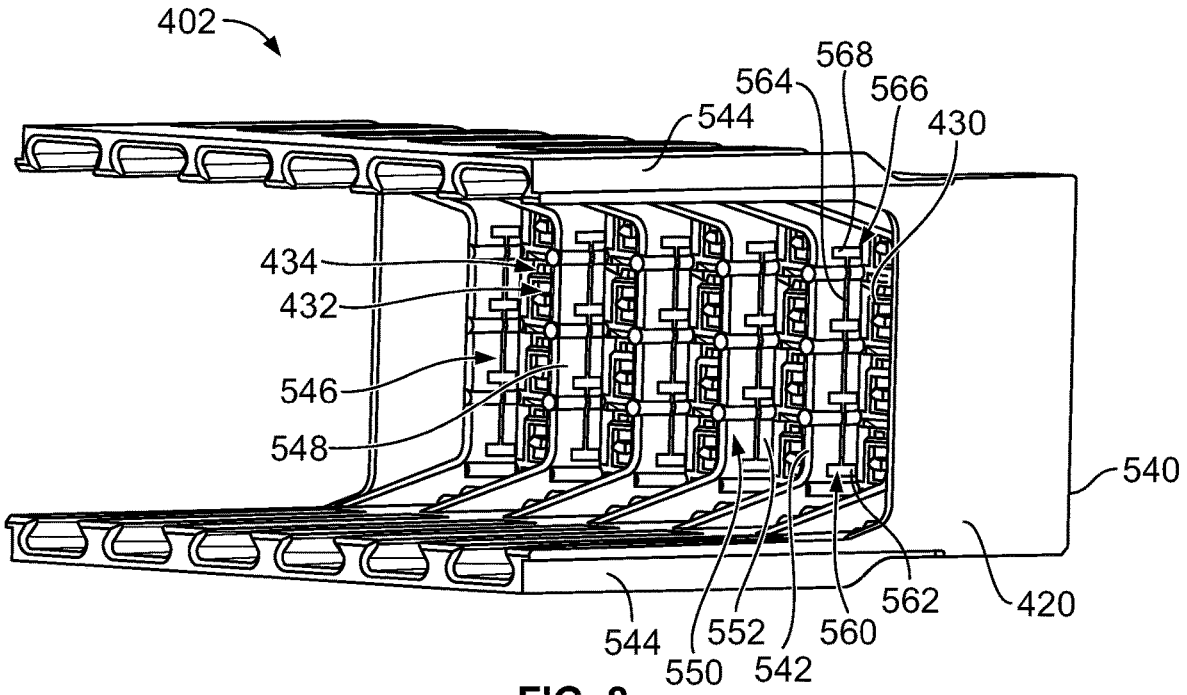
FIG. 8 is a rear perspective view of a receptacle housing of the receptacle assembly in accordance with an exemplary embodiment.

FIG. 8 is a rear perspective view of the receptacle housing 420 of the receptacle assembly 402 in accordance with an exemplary embodiment. The receptacle housing 420 includes the base 430. The base 430 includes a plurality of signal contact channels 432 and a plurality of ground contact channels 434. The receptacle signal contacts 424 (FIG. 7) are received in corresponding signal contact channels 432. The signal contact channels 432 may also receive corresponding header signal contacts 444 (FIG. 7) therein when the receptacle and header assemblies 402, 404 are mated. The ground contact channels 434 receive corresponding receptacle ground contacts 425 (FIG. 7) and are configured to receive header ground contacts 446 (FIG. 7) when the receptacle and header assemblies 402, 404 are mated. In an exemplary embodiment, the receptacle housing 420 includes the ground commoning conductors 560 within the ground contact channels 434 to electrically common the header ground contacts 446 and/or the receptacle ground contacts 425.

The base 430 extends between a front 540 and a rear 542. The receptacle housing 420 includes shroud walls 544 extending from the rear 542 at the top and bottom of the receptacle housing 420. The shroud walls 544 are used to support the contact modules 422 (FIG. 7) when loaded into the receptacle housing 420. In an exemplary embodiment, the base 430 includes a plurality of chambers 546 at the rear 542. The chambers 546 are separated by separating walls 548 of the base 430. Each chamber 546 receives a different contact module 422.

The ground contact channels 434 are surrounded by ground contact channel walls 550 having wall surfaces 552 that define the ground contact channels 434. The receptacle housing 420 of the receptacle assembly 402 includes the ground commoning conductors 560 within the receptacle housing 420. The ground commoning conductors 560 are used to electrically common multiple header ground contacts 446 (shown in FIG. 7) and/or receptacle ground contacts 425. The ground commoning conductors 560 include metal surface coverings 562 deposited on the ground contact channel walls 550. For example, the metal surface coverings 562 may be metal plating deposited directly on the wall surfaces 552. The ground commoning conductors 560 extend into multiple ground contact channels 434. The ground commoning conductors 560 are oriented within the ground contact channels 434 for direct electrical contact with a plurality of the header ground contacts 446 and/or the receptacle ground contacts 425. The ground commoning conductors 560 electrically common the corresponding header ground contacts 446 and/or the receptacle ground contacts 425.

In an exemplary embodiment, the metal surface coverings 562 of the ground commoning conductors 560 include pads 564 defining mating interfaces 566 oriented within the ground contact channels 434 for direct electrical contact with the corresponding header ground contacts 446 and/or the receptacle ground contacts 425. In an exemplary embodiment, the metal surface coverings 562 of the ground commoning conductors 560 include traces 568 between the pads 564. The traces 568 electrically connect the pads 564. In an exemplary embodiment, the metal surface coverings 562 of the ground commoning conductors 560 are plated surface coverings deposited directly on the dielectric material of the receptacle housing 420. The receptacle housing 420 is selectively plated.

Figure 9:
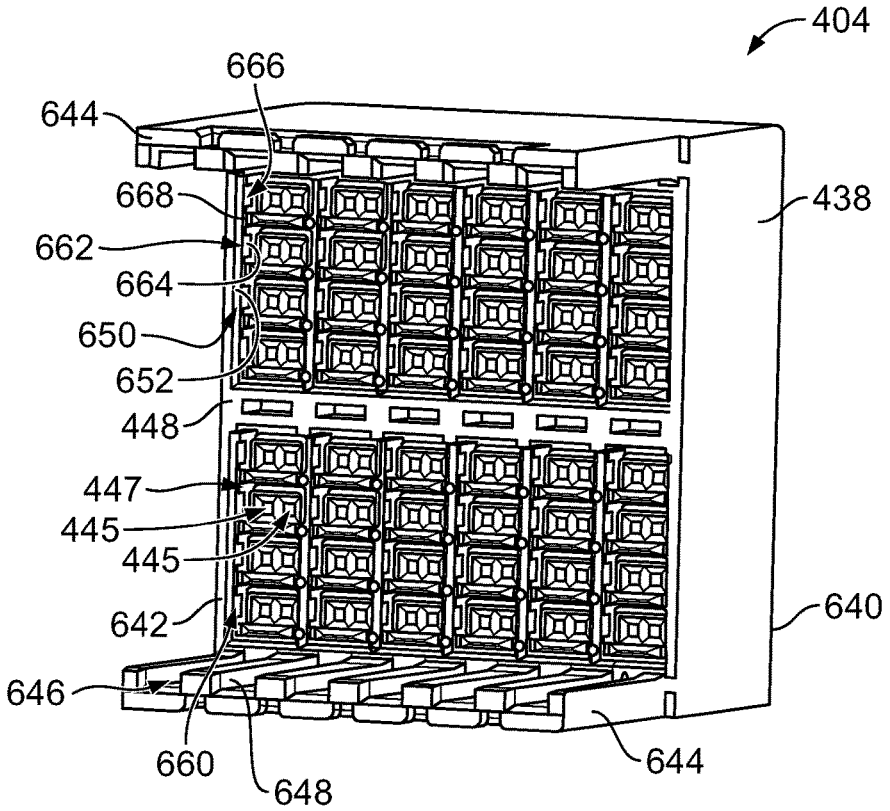
FIG. 9 is a rear perspective view of a header housing of the header assembly in accordance with an exemplary embodiment.

FIG. 9 is a rear perspective view of the header housing 438 of the header assembly 404 in accordance with an exemplary embodiment. The header housing 438 includes the base 448 extending between a front 640 and a rear 642. The header housing 438 includes shroud walls 644 extending from the rear 642 at the top and bottom of the header housing 438. The shroud walls 644 are used to support the contact modules 436 (FIG. 7) when loaded into the header housing 438. In an exemplary embodiment, the base 448 includes a plurality of chambers 646 at the rear 642. The chambers 646 are separated by separating walls 648 of the base 448. Each chamber 646 receives a different contact module 436.

The signal contact channels 445 and the ground contact channels 447 extend through the base 448. The ground contact channels 447 are surrounded by ground contact channel walls 650 having wall surfaces 652 that define the ground contact channels 447. In an exemplary embodiment, the header housing 438 of the receptacle assembly 402 includes the ground commoning conductors 660 within the header housing 438. The ground commoning conductors 660 are used to electrically common multiple header ground contacts 446. The ground commoning conductors 660 include metal surface coverings 662 deposited on the ground contact channel walls 650. For example, the metal surface coverings 662 may be metal plating deposited directly on the wall surfaces 652.

The ground commoning conductors 660 extend into multiple ground contact channels 447. For example, in various embodiments, the ground commoning conductors 660 extend into each of the ground contact channels 447 within the corresponding chamber 646. The ground commoning conductors 660 are oriented within the ground contact channels 447 for direct electrical contact with a plurality of the header ground contacts 446. The ground commoning conductors 660 electrically common the corresponding header ground contacts 446.

In an exemplary embodiment, the metal surface coverings 662 of the ground commoning conductors 660 include pads 664 defining mating interfaces 666 oriented within the ground contact channels 447 for direct electrical contact with the corresponding header ground contacts 446. In an exemplary embodiment, the metal surface coverings 662 of the ground commoning conductors 660 include traces 668 between the pads 664. The traces 668 electrically connect the pads 664. The header housing 438 is selectively plated in select areas designed to interface with the header ground contacts 446.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A connector assembly comprising:

a housing having a base extending between a front and a rear, the base having signal contact channels and ground contact channels extending therethrough, the ground contact channels having ground contact channel walls defining the ground contact channels;

signal contacts held in corresponding signal contact channels, the signal contacts having mating ends configured for mating with mating signal contacts;

ground contacts held in corresponding ground contact channels, the ground contacts having mating ends configured for mating with mating ends of mating ground contacts; and ground commoning conductors within the housing, the ground commoning conductors including metal surface coverings deposited on the corresponding ground contact channel walls, the metal surface coverings including plated traces extending along the ground contact channel walls, each ground commoning conductor extending into at least two ground contact channels, the ground commoning conductors oriented within the ground contact channels for direct electrical contact with at least two of the ground contacts or the mating ground contacts for electrically commoning the corresponding ground contacts or the mating ground contacts.

2. The connector assembly of claim 1, wherein the housing includes a dielectric material, the metal surface coverings being deposited directly on the dielectric material of the housing.

3. The connector assembly of claim 1, wherein the housing is selectively plated with the metal surface coverings to form the ground commoning conductors.

4. The connector assembly of claim 1, wherein the metal surface coverings include pads positioned in the ground contact channels and traces between the pads extending along the ground contact channel walls between the ground contact channels.

5. The connector assembly of claim 1, wherein the housing includes separating walls between the ground contact channels, the ground commoning conductors extending along the separating walls.

6. The connector assembly of claim 1, wherein each ground commoning conductor directly electrically contacts at least three of the ground contacts or the mating ground contacts.

7. The connector assembly of claim 1, wherein each ground commoning conductor includes a plurality of separable mating interfaces defining points of contact for electrically commoning the corresponding ground contacts or the mating ground contacts.

8. The connector assembly of claim 1, wherein the signal contacts include cable ends opposite the mating ends, the cable ends being terminated to corresponding cables.

9. The connector assembly of claim 1, wherein the ground contact channels are arranged in rows and columns, each ground commoning conductor extending into each ground contact channel within the corresponding column.

10. The connector assembly of claim 1, wherein the ground contact channels are arranged in rows and columns, each ground commoning conductor extending into each ground contact channel within the corresponding row.

11. A connector assembly comprising:

a housing having a base extending between a front and a rear, the base having signal contact channels and ground contact channels extending therethrough, the ground contact channels having ground contact channel walls defining the ground contact channels;

contact modules arranged in a contact module stack coupled to the rear of the base of the housing, each contact module having a plurality of cables extending from a rear of the contact module, each contact module having a frame holding signal contacts and ground contacts, the signal contacts having mating ends configured for mating with mating signal contacts, the signal contacts having cable ends terminated to signal conductors of the corresponding cables, the ground contacts being electrically connected to ground conductors of the corresponding cables, the ground contacts having mating ends configured for mating with mating ends of mating ground contacts; and ground commoning conductors within the housing, the ground commoning conductors including metal surface coverings deposited on the corresponding ground contact channel walls, the metal surface coverings including plated traces extending along the ground contact channel walls, each ground commoning conductor extending into at least two ground contact channels, the ground commoning conductors oriented within the ground contact channels for direct electrical contact with at least two of the ground contacts or the mating ground contacts for electrically commoning the corresponding ground contacts or the mating ground contacts.

12. The connector assembly of claim 11, wherein the ground commoning conductors are configured to directly electrically contact each of the ground contacts of the corresponding contact module or the mating ground contacts associated with the corresponding contact module.

13. The connector assembly of claim 11, wherein each ground commoning conductor directly electrically contacts at least three of the ground contacts or the mating ground contacts.

14. The connector assembly of claim 11, wherein the housing is selectively plated with the metal surface coverings to form the ground commoning conductors.

15. The connector assembly of claim 11, wherein the metal surface coverings include pads positioned in the ground contact channels and traces between the pads extending along the ground contact channel walls between the ground contact channels.

16. An electrical connector system comprising:

a header assembly comprising a header housing, header signal contacts arranged in pairs and held by the header housing, and header ground contacts held by the header housing, each header ground contact having a mating end having an end wall, a first side wall extending from the end wall and a second side wall extending from the end wall, the end wall, the first side wall, and the second side wall defining a C-shaped shield surrounding the corresponding pair of header signal contacts; and a receptacle assembly matable to the header assembly, the receptacle assembly comprising:

a receptacle housing having a base extending between a front and a rear, the base having signal contact channels and ground contact channels extending therethrough, the signal contact channels receiving corresponding header signal contacts when mated to the header assembly, the ground contact channels receiving corresponding header ground contacts when mated to the header assembly, the ground contact channels having ground contact channel walls defining the ground contact channels;

receptacle signal contacts held in corresponding signal contact channels, the receptacle signal contacts having mating ends mated with corresponding header signal contacts in the signal contact channels;

receptacle ground contacts held in corresponding ground contact channels, the receptacle ground contacts having mating ends mated with mating ends of corresponding header ground contacts; and ground commoning conductors within the receptacle housing, the ground commoning conductors including metal surface coverings deposited on the corresponding ground contact channel walls, the metal surface coverings including plated traces extending along the ground contact channel walls, each ground commoning conductor extending into at least two ground contact channels, the ground commoning conductors oriented within the ground contact channels for direct electrical contact with at least two of the header ground contacts for electrically commoning the corresponding header ground contacts.

17. The electrical connector system of claim 16, wherein the receptacle assembly further comprises contact modules arranged in a contact module stack coupled to the rear of the base of the housing, each contact module holding corresponding receptacle signal contacts and receptacle ground contacts.

18. The electrical connector system of claim 16, wherein the receptacle assembly further comprises a plurality of cables, the receptacle signal contacts having cable ends terminated to signal conductors of the corresponding cables.

19. The electrical connector system of claim 16, wherein each ground commoning conductor directly electrically contacts at least three of the ground contacts or the mating ground contacts.

20. The electrical connector system of claim 16, wherein the metal surface coverings include pads positioned in the ground contact channels and traces between the pads extending along the ground contact channel walls between the ground contact channels.

* * * * *